United States Patent [19]

Fox

[11] Patent Number: 5,060,811

[45] Date of Patent: Oct. 29, 1991

[54] BABY BOTTLE

[76] Inventor: Martha Fox, 730 E. 19th St., Erie, Pa. 16503

[21] Appl. No.: 571,879

[22] Filed: Aug. 24, 1990

[51] Int. Cl.[5] ..... A61J 9/00; A61J 11/04; A65D 1/04; A65D 25/52

[52] U.S. Cl. ..... 215/6; 215/11.1; 215/11.4

[58] Field of Search ..... 215/6, 11.4, 11.5, 11.1; 222/144.5; 251/155, 156

[56] References Cited

U.S. PATENT DOCUMENTS

| | | | |
|---|---|---|---|
| 557,352 | 3/1896 | Bender | 215/6 X |
| 990,662 | 4/1911 | MacGlashan | 215/11.4 |
| 2,372,281 | 3/1945 | Jordan | 215/11.5 |
| 2,745,568 | 5/1956 | Newton | 215/11.4 |
| 3,076,573 | 2/1963 | Thomas | 215/6 |
| 4,723,668 | 2/1988 | Cheng | 215/11.5 |
| 4,856,995 | 8/1989 | Wagner | 215/6 X |

*Primary Examiner*—Sue A. Weaver

[57] ABSTRACT

A baby feeding bottle divided into two compartments and a nipple. A valve connecting the nipple to the bottle which selectively connects one or the other of the compartments to the nipple or disconnects both compartments.

4 Claims, 1 Drawing Sheet

BABY BOTTLE

BACKGROUND OF THE INVENTION

This invention relates to baby bottles and more particularly to a two-compartment baby bottle from which a baby can be fed two separate foods from the same bottle, thus eliminating the need for more than one bottle.

Baby diets often require two different liquid foods, for example, milk and orange juice. This requires two separate bottles and nipples. It becomes inconvenient when the baby is taken along shopping or during traveling to carry two bottles. Applicant has discovered that a single bottle can be used for two different liquids with applicant's improved bottle and nipple.

Applicant has no knowledge of any relevant prior art.

SUMMARY OF THE INVENTION

The baby bottle of the present invention has a partition that divides the bottle into two separate compartments. A cover closes the bottle and a nipple having a valve means on it is provided by which the nipple can be connected selectively to either of the two compartments.

It is an object of the invention to provide an improved nursing bottle.

Another object of the invention is to provide a nursing bottle that is divided into two halves and will selectively feed from either half to feed either of two liquids.

Another object of the invention is to provide a nursing bottle and nipple combination that is simple in construction, economical to manufacture and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

DESCRIPTION OF THE PREFERRED EMBODIMENT

Figure 1:
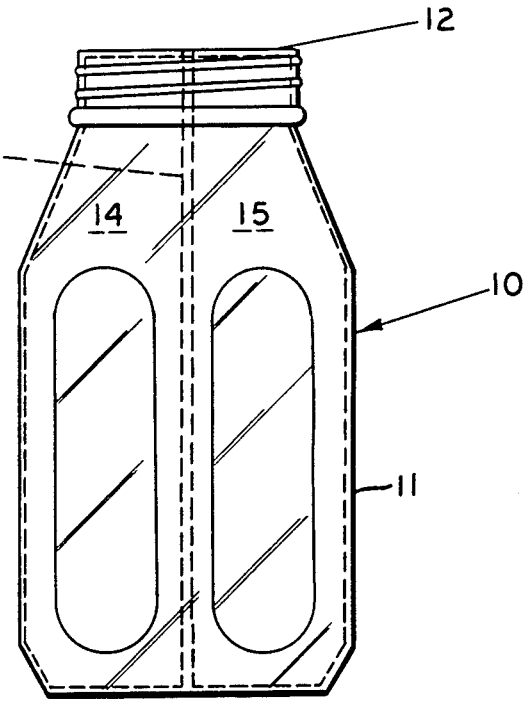
FIG. 1 is a side view of the bottle according to the invention.
Figure 2:
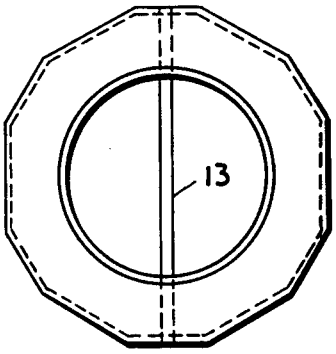
FIG. 2 is a top view of the bottle shown in FIG. 1.
Figure 3:
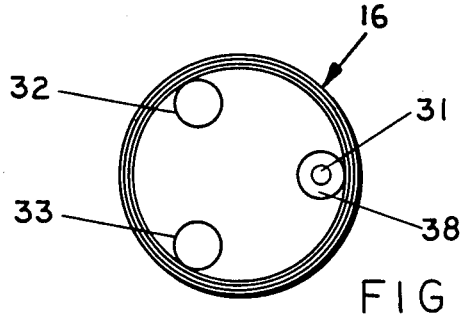
FIG. 3 is a bottom view of the nipple shown in FIG. 4.
Figure 4:
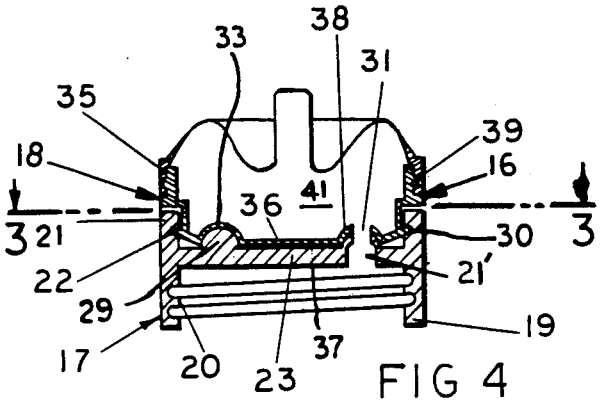
FIG. 4 is a longitudinal cross-sectional view of the nipple, valve and closure for the bottle according to the invention.
Figure 5:
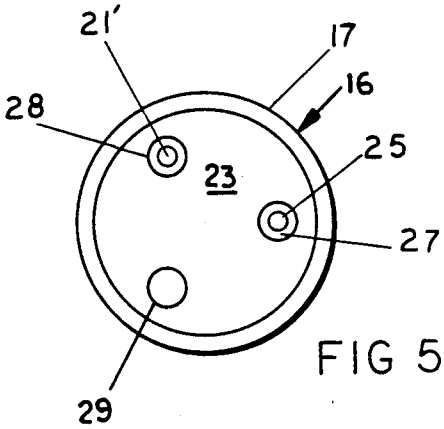
FIG. 5 is a top view of the closure with the cover and valve removed.

Now with more particular reference to the drawings, FIG. 1 shows combination 10 comprising nursing bottle 11, closure 17, valve 18 and nipple 16. Nursing bottle 11 has externally threaded open end 12, partition 13 which divides nursing bottle 11 into first compartment 14 and second compartment 15. Partition 13 terminates at its top edge in the plane passing through open end 12.

Closure 17 is threadably supported on nursing bottle 11. Diaphragm 36 rests on wall 23 of closure 17. Gasket 37 rests on wall 23 and forms a seal between open end 12 of nursing bottle 11 and the upper edge of partition 13 with wall 23 of closure 17. Closure 17 has downwardly extending flange 19 with internal threads 20 that threadably receive externally threaded open end 12 of bottle 11. Upwardly extending flange 21 has groove 30 which receives bead 22 on diaphragm 36. Bead 22 slides in groove 30 when nipple 16 is rotated. Nipple 16 terminates at its lower end in flange 19. Flange 19 is adapted to be engaged by a hand to rotate nipple 16. The frictional force between internal threads 35 on nipple 16 and external threads 39 on valve 18 will be greater than the sum of the friction between diaphragm 36 and wall 23 and the friction between bead 22 and the side wall of groove 30. Therefore nipple 16 will not be unscrewed from closure 17. Nipple 16 is attached to diaphragm 36 and together make up valve 18. External threads 39 on valve 18 are received in internal threads 35 on nipple 16. Diaphragm 36 has three generally hemispheric nests; first nest 32, second nest 33 and third nest 38 equally spaced at 120 degree intervals from one another around the center of cylindrical closure 17.

Wall 23 has three equally spaced generally hemispheric projections; first projection 27, second projection 28 and third projection 29 equally spaced from one another at 120 degree intervals around the center of cylindrical closure 17. First projection 27, second projection 28 and third projection 29 will each be nested in first nest 32, or second nest 33 or third nest 38 at any particular time.

Third nest 38 has central opening 31. First nest 32 and second nest 33 have no openings. First projections 27 has central opening 25. Second projection 28 has central opening 21'. Third projection 29 has no opening.

In a first position of nipple 16, first projection 27 will be nested in third nest 38, central opening 31 of third nest 38 will be connected with central opening 25 of first projection 27 and nipple 16 will be connected with either first compartment 14 or second compartment 15 that may be aligned with central opening 25 of first projection 27. Since second projection 28 and will be nested in first nest 32 and second nest 33, which have no holes, no liquid will flow from them.

In a second position, when nipple 16 is rotated whereby second projection 38 is nested in third nest 38, central opening 31 of third nest 38 will be aligned with central opening 21' of second projection 28 and nipple 16 will be connected to either first compartment 14 or second compartment 15.

In a third position, when nipple 16 is rotated to a position to locate third projection 29 in third nest 38, since third projection 29 has no central opening, central opening 31 of third nest 38 will be blocked and no liquid can flow from either first compartment 14 or second compartment 15.

Thus, nipple 16 can be selectively rotated to align central opening 31 of third nest 38 with either central opening 21' of second projection 28, central opening 25 of first projection 27, connecting nipple 16 to either first compartment 14 or second compartment 15, or to no opening thereby connecting nipple 16 to neither first compartment 14 or second compartment 15.

Obviously, nursing bottle 11 could be divided into three or four parts and nipple 16 provided with additional openings for feeding three or more liquids.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A nursing bottle and valve combination comprising a valve and a bottle having a cylindrical externally threaded open end, a partition dividing said bottle into a first compartment and a second compartment, said partition terminating in a plane passing through said open end of said bottle, a closure including means for threadably supporting said closure on said threaded open end of said bottle, said valve comprising a nipple supported on a diaphragm and means rotatably connecting said valve to said closure, said closure including a wall having openings therein aligned with said compartments, said diaphragm having an opening therein and being rotatably supported on said wall and disposed to cooperate with said openings in said wall and said opening in said diaphragm being adapted to be aligned with one of said openings in said wall as said valve is rotated with respect to said closure whereby said first compartment, said second compartment or neither compartment can be connected to said nipple.

2. The combination recited in claim 1 wherein said closure has sealing means thereon and said open end of said bottle and said partition engages said sealing means providing a seal between said partition, said open end and said closure.

3. A nursing bottle and valve combination comprising a valve and a bottle having an externally threaded open end, a partition dividing said bottle into a first compartment and a second compartment, said partition terminating in a plane passing through said open end of said bottle, a closure supported on said bottle, said valve including a nipple, a diaphragm and connecting means rotatably connecting said valve to said closure, said closure having a wall having a first projection, a second projection and a third projection spaced from one another concentric to said externally threaded open end of said bottle, said first projection having an opening in its center aligned with one of said compartments and said second projection having an opening in its center aligned with the other of said compartments, said diaphragm supported on said wall concentric to said externally threaded open end, said diaphragm having a first nest, a second nest and a third nest disposed concentric to said threaded open end of said bottle, said nests each being disposed to successively receive each of said projections, said third nest having a center opening, said valve being adapted to selectively align said opening in said center of said first projection or said opening in said center of said second projection with said center opening in said third nest when rotated with respect to said closure, whereby liquid can be selectively drawn through said valve from said first compartment or said second compartment of said bottle.

4. The combination recited in claim 3 wherein said valve includes hand engaging means adapted to rotate said diaphragm to selectively bring each said projection to nest in a said nest.

* * * * *